US006769942B2

(12) United States Patent
Bourret et al.

(10) Patent No.: US 6,769,942 B2
(45) Date of Patent: Aug. 3, 2004

(54) WATERCRAFT HAVING AIR/WATER SEPARATING DEVICE

(75) Inventors: Robert Bourret, Palm Bay, FL (US); Dominic Dagenais, Canton de Shefford (CA); Eric Ouellette, Austin (CA); Gaétan Lecours, Valcourt (CA); Andreas Winter, St. Pölten (AT); Wolfgang Schrenk, Linz (AT)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 09/925,729

(22) Filed: Aug. 10, 2001

(65) Prior Publication Data

US 2002/0100405 A1 Aug. 1, 2002

Related U.S. Application Data

(60) Provisional application No. 60/224,355, filed on Aug. 11, 2000.

(51) Int. Cl.[7] ..... B63H 21/10; B01D 50/00

(52) U.S. Cl. ..... 440/88 A; 55/385.3

(58) Field of Search ..... 440/88, 89, 88 R, 440/88 A, 88 F, 89 F; 55/385.3; 180/68.3, 69.25

(56) References Cited

U.S. PATENT DOCUMENTS

| | | | | | |
|---|---|---|---|---|---|
| 4,035,171 | A | * | 7/1977 | Reed et al. | 96/190 |
| 4,198,217 | A | * | 4/1980 | Erdmannsdorfer | 55/385.5 |
| 4,212,659 | A | * | 7/1980 | Magrini | 55/385.3 |
| 4,326,374 | A | * | 4/1982 | Streb | 60/39.092 |
| 4,982,682 | A | * | 1/1991 | Hattori | 114/55.51 |
| 4,984,528 | A | * | 1/1991 | Kobayashi | 114/55.51 |
| 5,088,280 | A | * | 2/1992 | Scott-Scott et al. | 60/257 |
| 5,340,343 | A | * | 8/1994 | Kawamukai et al. | 440/88 |
| 5,340,344 | A | * | 8/1994 | Mineo et al. | 440/88 |
| 5,390,621 | A | * | 2/1995 | Hattori et al. | 114/55.51 |
| 5,660,571 | A | * | 8/1997 | Nakayasu et al. | 440/88 |
| 5,743,206 | A | * | 4/1998 | Hattori | 114/55.51 |
| 5,906,083 | A | * | 5/1999 | Olsen et al. | 52/473 |
| 5,951,343 | A | * | 9/1999 | Nanami et al. | 440/88 |
| 5,960,770 | A | * | 10/1999 | Taue et al. | 123/317 |
| 6,015,321 | A | * | 1/2000 | Ozawa et al. | 440/88 R |
| 6,149,477 | A | * | 11/2000 | Toyama | 440/88 |
| 6,171,380 | B1 | * | 1/2001 | Wood et al. | 96/386 |
| 6,302,752 | B1 | * | 10/2001 | Ito et al. | 440/88 R |
| 6,447,351 | B1 | * | 9/2002 | Nanami | 440/88 |
| 6,623,321 | B2 | | 9/2003 | Ishino | |

OTHER PUBLICATIONS

Bombardier "Sea–Doo," Parts Catalog 2000, GS 5644/5827, p. C2, Dec. 1999.

Bombardier "Sea–Doo," Parts Catalog 2000, XP 5651/5655, p. C2 and C3, Jan. 2000.

* cited by examiner

*Primary Examiner*—Andrew Wright
(74) *Attorney, Agent, or Firm*—BRP Legal Services

(57) ABSTRACT

A watercraft comprises a hull, an internal combustion engine, a propulsion system, and an air/water separating device. The separating device comprises a container having an inlet port and an outlet port. The inlet port enables at least ambient air to enter the container and the outlet port is communicated to the air intake of the engine. The separating device has structure providing spaced apart generally vertical surfaces that define a plurality of elongated tortuous paths between the inlet and outlet ports. The tortuous paths have one or more angular portions and are positioned and configured such that the ambient air passes through the elongated tortuous paths so that water suspended in the air is separated from the air as the air passes through angular portions of the paths with the separated water flowing downwardly along the surfaces to a bottom of the container by gravity.

38 Claims, 16 Drawing Sheets

WATERCRAFT HAVING AIR/WATER SEPARATING DEVICE

This application claims priority to U.S. Provisional Patent Application Serial No. 60/224,355 filed on Aug. 11, 2000, the entirety of which is hereby incorporated into the present application by reference.

FIELD OF THE INVENTION

The present invention relates to a watercraft for traveling along a surface of a body of water.

BACKGROUND AND SUMMARY OF THE INVENTION

Watercraft, especially those of the type known as personal watercraft, are commonly powered by internal combustion engines positioned within their hulls. These engines are arranged to drive a water propulsion device for propelling the craft.

As is well known, it is undesirable to allow water to enter the intake system of such an engine, as the water may mix with air within the combustion chamber(s) and cause the engine to stall or stop. Water can remove lubrication from the cylinder wall and water in the crankcase may lead to corrosion of the crankcase's internal components and water in the piston head to lead to hydrolock. Generally, watercraft have a sealed hull assembly with vent openings that enable ambient air to enter the hull assembly for use by the engine during combustion. Air conduits transport the air from the vent openings to vent hoses. The vent hoses open generally downwardly to direct the air to the bottom of the watercraft so that at least some of the water present in the air will drop out of the air to the bottom of the hull and flow to a bilge for drainage. The air within the hull assembly is drawn through an airbox, which is connected to the engine.

The air is drawn into the interior of the airbox via one or more intake ports. The air passes through the interior and exits via one or more outlet ports that are connected to the engine. The airbox is the final barrier to remove water suspended in the air. Thus, it is preferable that the airbox remove most, if not all, of the water from the air before the air is supplied to the engine.

Consequently, there is a constant need in the art to increase the efficiency and effectiveness of airboxes used with watercraft.

To achieve this need, there is provided a watercraft comprising a hull, an internal combustion engine, a propulsion system, and an air/water separating device. The internal combustion engine has an air intake for receiving at least ambient air to be supplied to the engine. The propulsion system is connected to the engine and is constructed and arranged to propel the watercraft along a surface of a body of water using power from the engine. The air/water separating device comprises a container enclosing an interior space and having an inlet port and an outlet port. The inlet port enables ambient air to enter the container and the outlet port is communicated to the air intake of the engine so as to enable the engine to draw the ambient air into the air intake through the inlet port, the interior of the container and the outlet port. The air/water separating device has structure providing spaced apart generally vertical surfaces defining a plurality of elongated tortuous paths between the inlet and outlet ports. The tortuous paths have one or more angular portions and are positioned and configured such that, as the engine draws the ambient air through the container interior, the ambient air passes through the elongated tortuous paths so that water suspended in the air is separated from the air as the air passes through angular portions of the paths with the separated water flowing downwardly along the surfaces to a bottom of the container by gravity. The container has one or more apertures at the bottom thereof so as to enable the water flowing to the bottom of the container to flow out from the container.

In accordance with another aspect of the present invention, there is provided a watercraft comprising a hull, an internal combustion engine, a propulsion system, and an air/water separating device. The internal combustion engine has an air intake for receiving at least ambient air to be supplied to the engine. The propulsion system is connected to the engine and is constructed and arranged to propel the watercraft along a surface of a body of water using power from the engine. The air/water separating device comprises a container enclosing an interior space and having an upwardly facing inlet port and an outlet port. The inlet port enables ambient air to enter the container and the outlet port is communicated to the air intake of the engine so as to enable the engine to draw the ambient air through the inlet port, the interior of the container and the outlet port. The air/water separating device includes a shield member disposed in covering relation above the inlet port to prevent water present in the ambient air from travelling directly downwardly into the inlet port.

In accordance with another aspect of the present invention, there is provided a watercraft comprising a hull, an internal combustion engine, a propulsion system, a conduit, and an air/water separating device. The internal combustion engine has an air intake for receiving at least ambient air to be supplied to the engine. The propulsion system is connected to the engine and is constructed and arranged to propel the watercraft along a surface of a body of water using power from the engine. The conduit is connected at one end thereof to the air intake. The air/water separating device is mounted within the hull in spaced apart relation from the engine. The air/water separating device comprises a container enclosing an interior space. The container has an inlet port enabling ambient air to enter the container and an outlet port connected to the other end of the conduit so as to enable the engine to draw the ambient air into the air intake thereof through the inlet port, the interior of the container, the outlet port, and the conduit.

In accordance with another aspect of the present invention, there is provided a watercraft comprising a hull, an internal combustion engine, a propulsion system, and an air/water separating device. The internal combustion engine has an air intake for receiving at least ambient air to be supplied to the engine. The propulsion system is connected to the engine and is constructed and arranged to propel the watercraft along a surface of a body of water using power from the engine. The air/water separating device comprises a container enclosing an interior space. The container has an inlet port enabling ambient air to enter the container and an outlet port communicated to the air intake of the engine so as to enable the engine to draw the ambient air through the inlet port, the interior of the container and the outlet port. The container includes at least one wall defining a first chamber and a second chamber within the container. The wall has at least one opening formed therethrough to communicate the first and second chambers such that the ambient air being drawn by the engine flows from the first chamber to the second chamber via the opening. The at least one opening is spaced upwardly from a floor surface of the container and the wall is constructed and arranged to prevent any water that has become separated from the air in the container from flowing along the floor surface between the first and second chambers. The container has one or more apertures at the bottom surface thereof so as to enable the water flowing along the bottom surface to flow out from the container.

In accordance with another aspect of the present invention, there is provided a watercraft comprising a hull, a fuel tank containing a supply of fuel, an internal combustion engine, a propulsion system, and an air/water separating device. The internal combustion engine is communicated with the fuel tank and has an air intake for receiving at least ambient air to be supplied to the engine from the fuel tank. The propulsion system is connected to the engine and is constructed and arranged to propel the watercraft along a surface of a body of water using power from the engine. The air/water separating device comprises a container enclosing an interior space. The container has an inlet port enabling ambient air to enter the container and an outlet port communicated to the air intake of the engine so as to enable the engine to draw the ambient air through the inlet port, the interior of the container and the outlet port. The fuel tank has a recess formed therein and the container of the air/water separating device is mounted to the fuel tank within the recess.

In accordance with still another aspect of the present invention, a watercraft is provided with a hull and an internal combustion engine with an air intake for receiving at least ambient air to be supplied to the engine. The watercraft has a propulsion system connected to the engine and is arranged to propel the watercraft along the surface of a body of water. The watercraft has an air/water separating device with a container enclosing an interior space. The container includes an inlet and an outlet port. The inlet port permits ambient air to enter the container while the outlet port is communicated with the intake of the engine to permit ambient air to be drawn into the engine. The watercraft further includes a heat exchanger connected to a component of the watercraft, the heat exchanger being adapted to draw heat from the electrical component. The heat exchanger is mounted within an opening in the container of the air/water separating device such that the heat exchanger is positioned in the flow of air through the container to dissipate the heat drawn from the component.

These and other objects, features, and advantages of this invention will become apparent from the following detailed description when taken into conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE PREFERRED EMBODIMENTS

Figure 1:
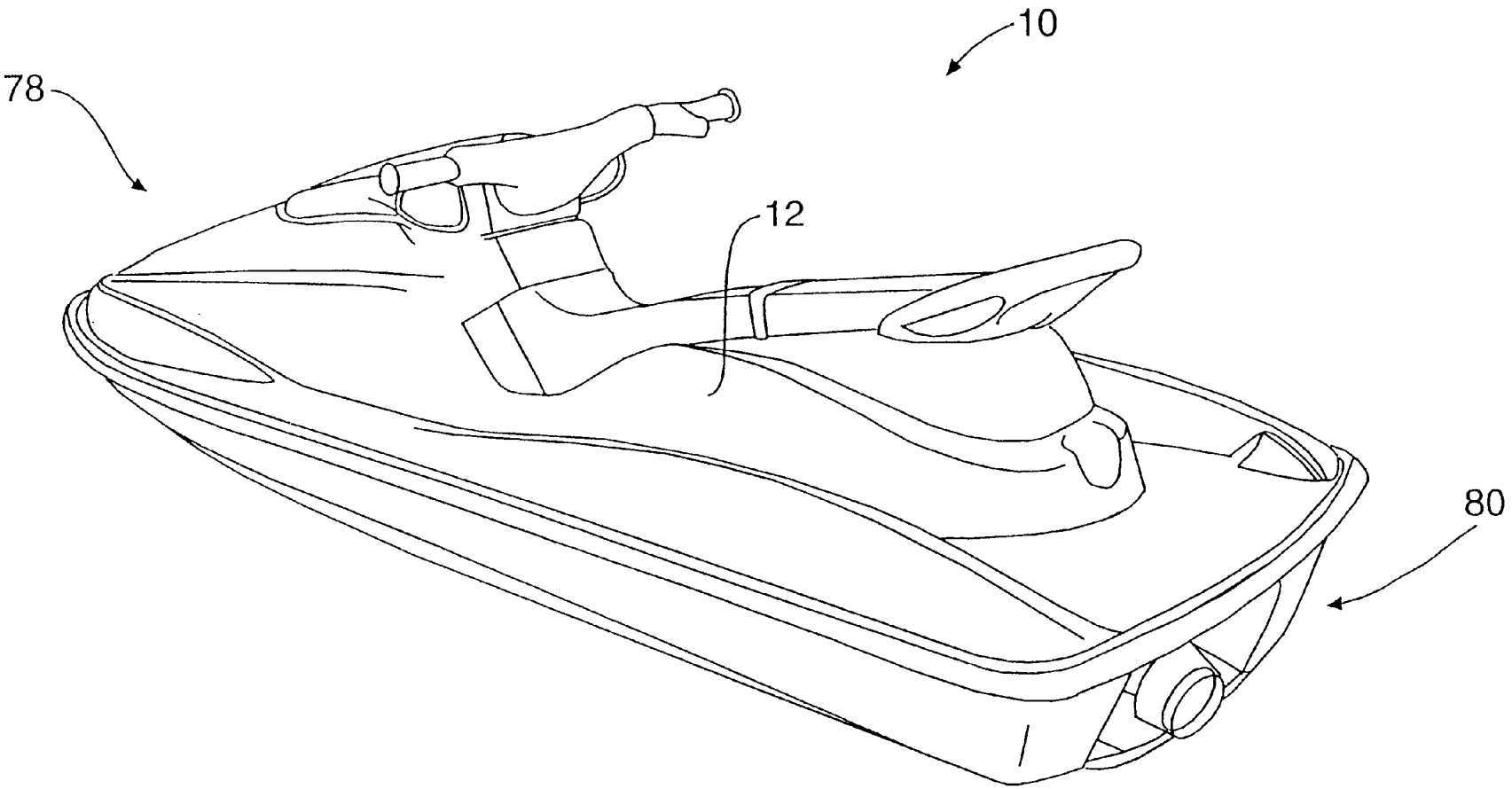
FIG. 1 is a perspective view of a watercraft for traveling along a surface of a body of water.
Figure 2:
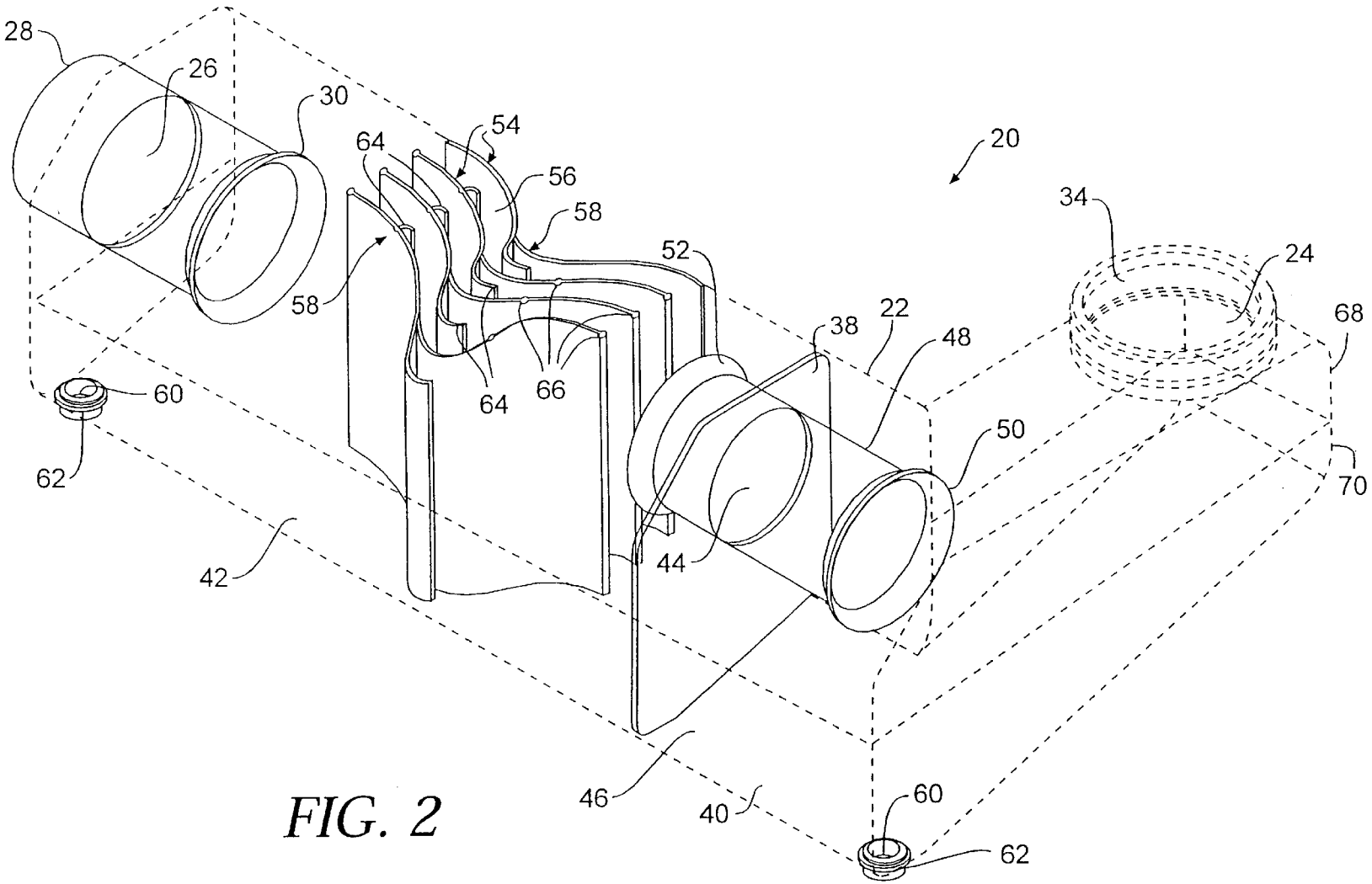
FIG. 2 is a perspective view of an air/water separating device constructed in accordance with the principles of the present invention with the internal components in solid to more clearly show their structure and interaction.
Figure 3:
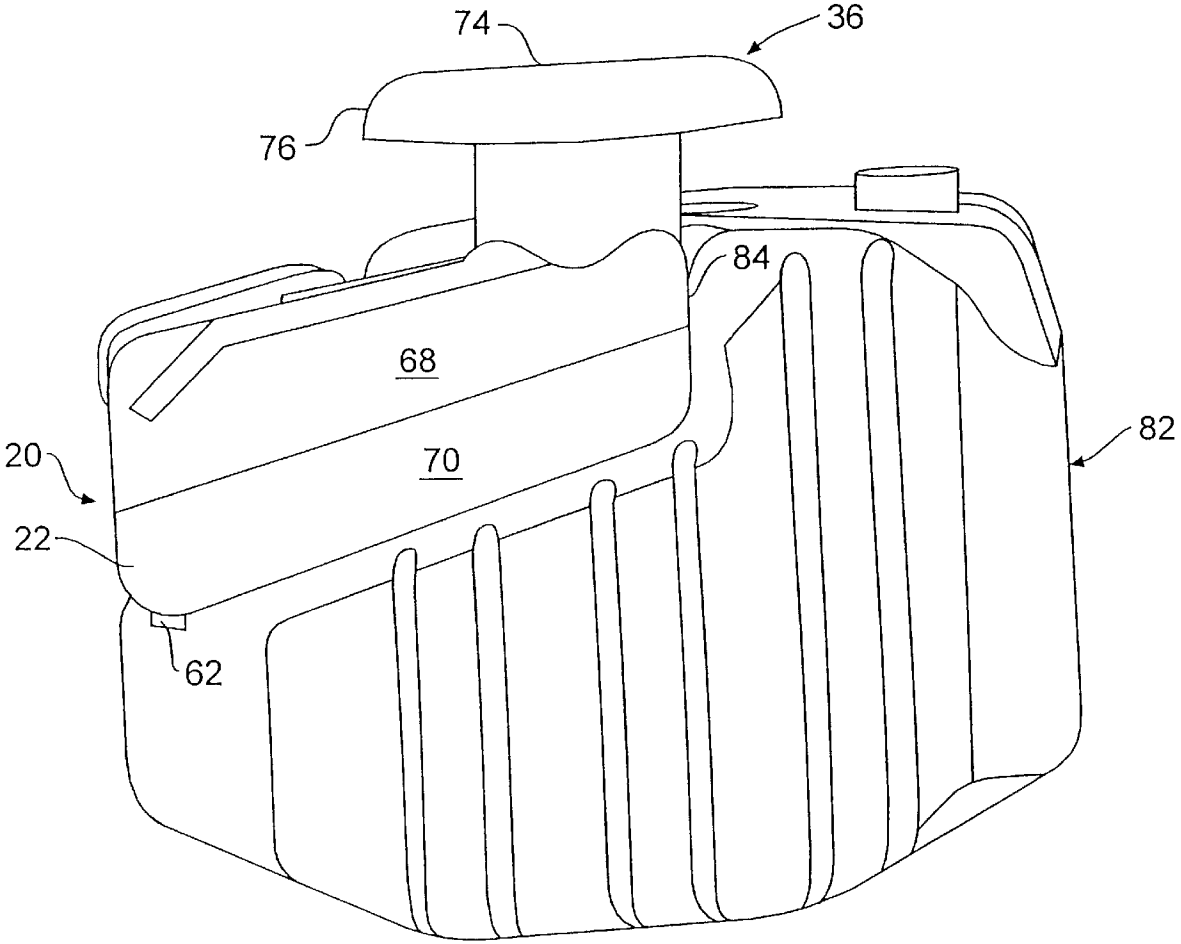
FIG. 3 is a front view of the air/water separating device mounted on the fuel tank of the watercraft.
Figure 4:
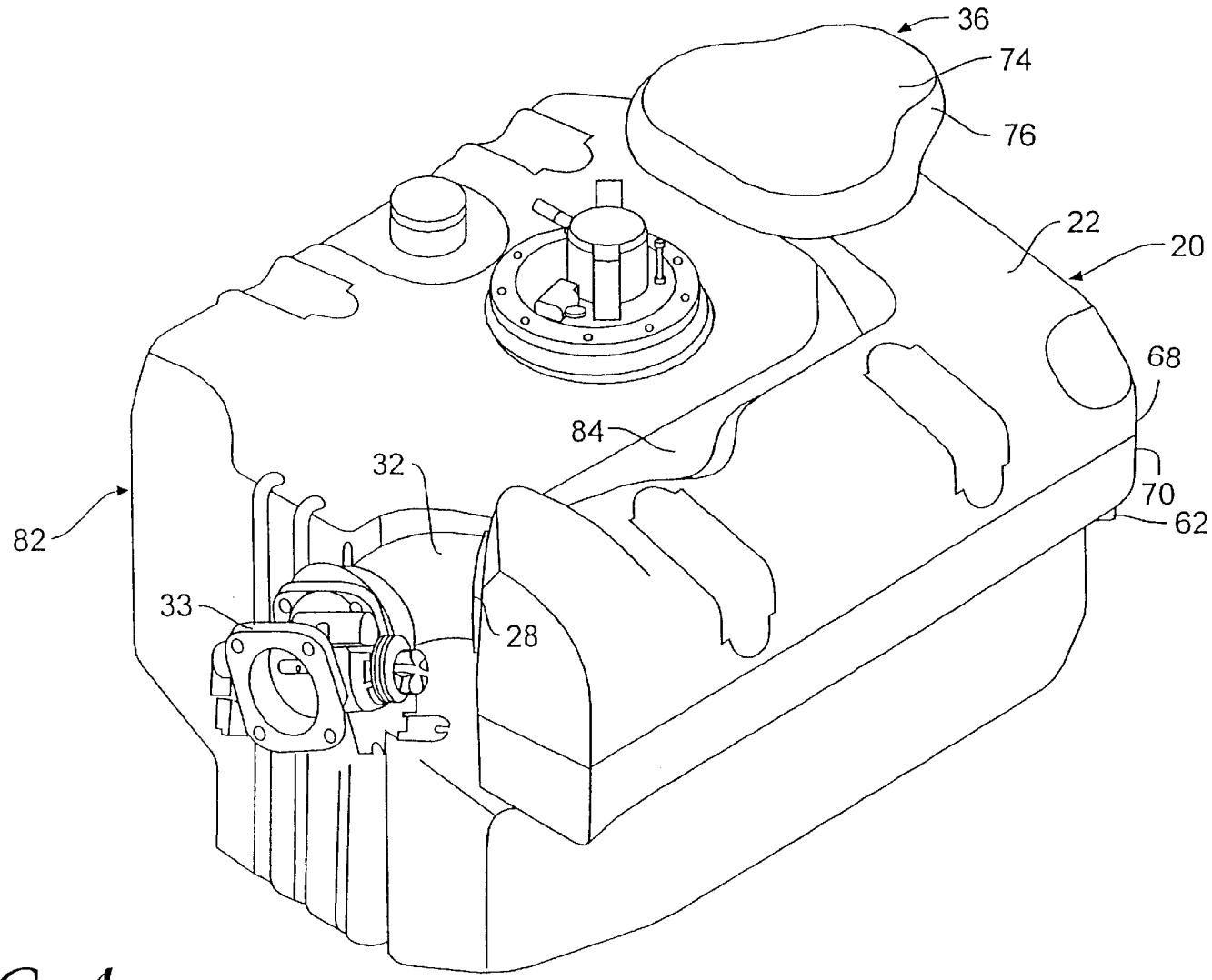
FIG. 4 is a perspective view of the air/water separating device mounted on the fuel tank of the watercraft.

FIG. 1 shows a watercraft, generally shown at 10, for traveling along a surface of a body of water. The watercraft 10 comprises a hull 12 for buoyantly supporting the watercraft 10 on the surface of the body of water. The hull 12 is typically molded from fiberglass material and lined internally with buoyant foam material.

Figure 5:
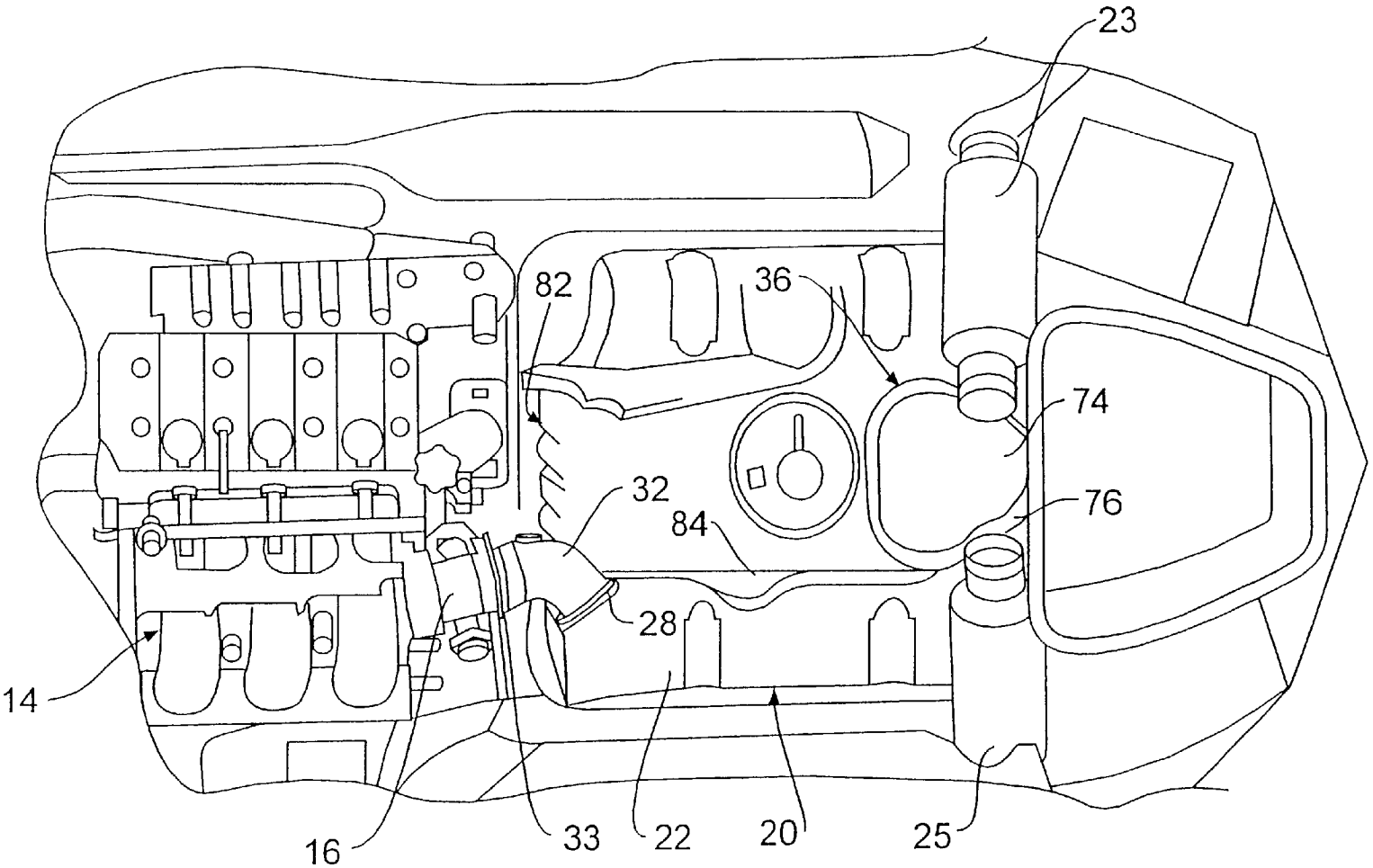
FIG. 5 is a top sectional view showing the air/water separating device in relation to the other components of the watercraft.
Figure 6:
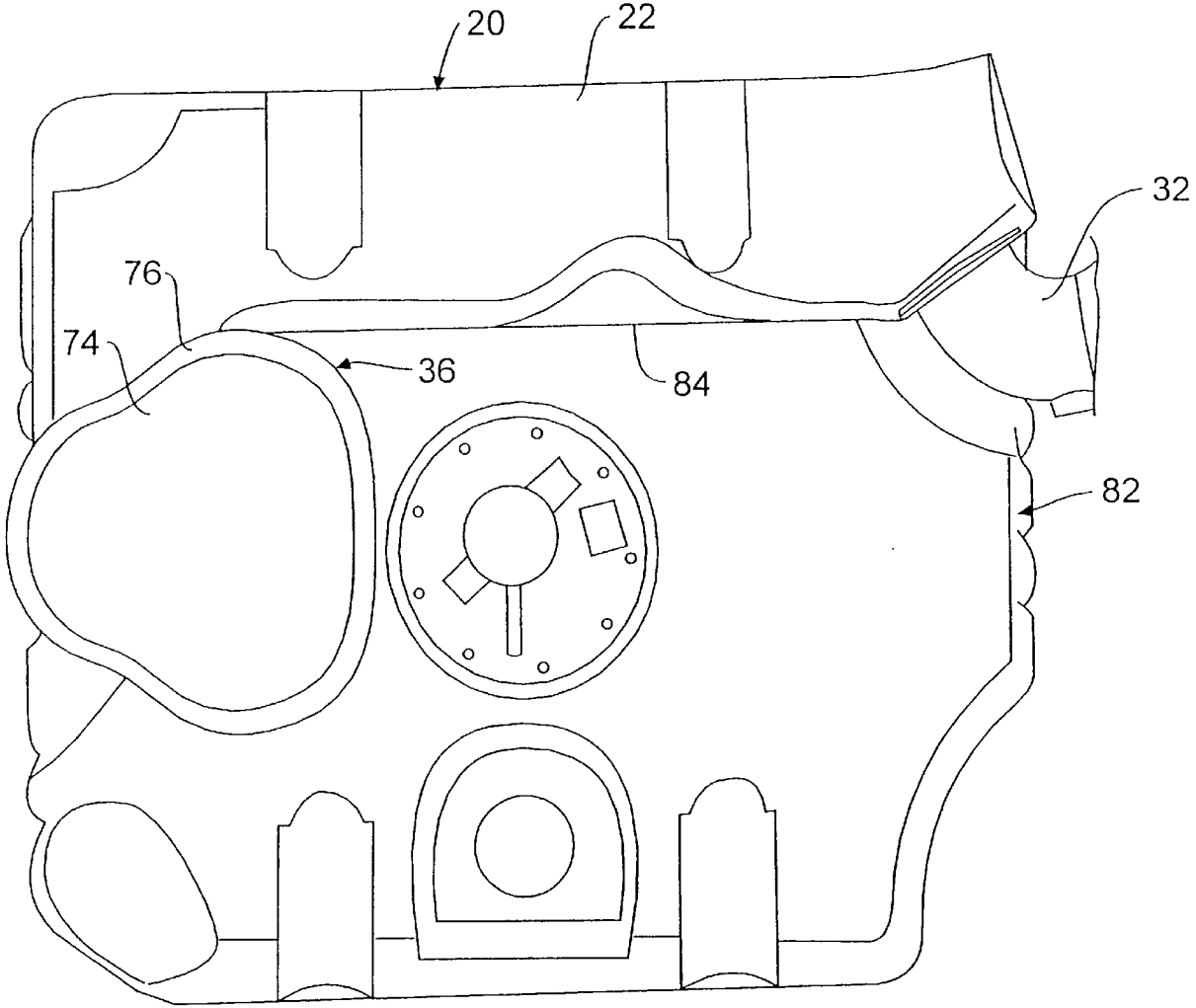
FIG. 6 is a top view of the air/water separating device mounted on the fuel tank of the watercraft.

An internal combustion engine, generally shown at 14 in FIG. 5, is carried by and within the hull 12. As is well-known in the art, the engine 14 includes a plurality of cylinders and a plurality of reciprocating pistons received within the cylinders. The pistons are connected to an output shaft to affect rotary motion thereof in a well-known manner. Specifically, the pistons reciprocate within the plurality of cylinders through a combustion cycle wherein a mixture of air and fuel are combusted sequentially with the cylinders to drive the pistons for affecting rotational movement of the output shaft. The engine may be of the four-stroke or two-stroke type. The engine 14 has an air intake 16 for receiving air to be mixed with the fuel supplied to the engine 14. The engine 14 may be of any construction.

Figure 8:
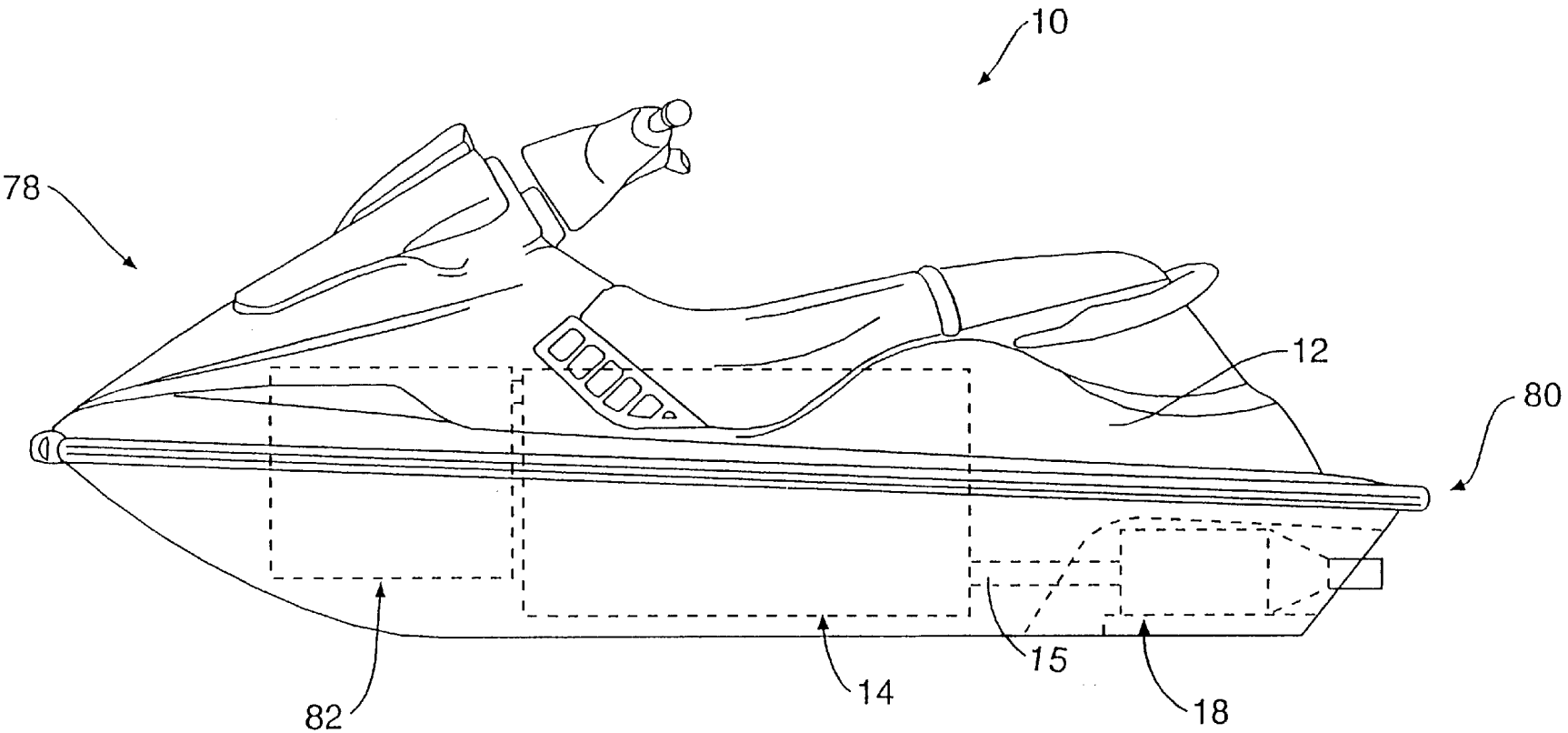
FIG. 8 is a side view of FIG. 1 showing internal components of the watercraft in phantom.

A propulsion system, generally shown at 18 in FIG. 8, is connected to the output shaft of the engine 14. The propulsion system 18 typically includes a propelling structure, such as a propeller or impeller, connected to one end of a driveshaft 15 with the other end of the driveshaft 15 coupled to the output shaft so that powered rotation of the output shaft rotates the propelling structure via the driveshaft 15. The propelling structure is constructed and arranged to displace water during rotation thereof so as to propel the watercraft 10 along the surface of the body of water. The propulsion system 14 may have any construction and its specific design is not important to the present invention.

Referring now more particularly to FIGS. 2–7, an air/water separating device, generally shown at 20, embodying the principles of the present invention, is mounted within the hull 12. The air/water separating device 20 comprises a container 22 enclosing an interior space. The container 22 has an upwardly facing inlet port 24 and an outlet port 26. The inlet port 24 enables ambient air within the hull 12 to enter the container 22. As is well-known in the art, the hull 12 has a plurality of vent openings that enable ambient air to enter the hull 12 for use by the engine 14 during combustion. Air conduits (not shown) transport the air from the vent openings to vent hoses, such as vent hoses 23, 25 shown in FIG. 5. The vent hoses 23, 25 direct the air to the bottom of the hull 12 so that at least some of the water present in the air will flow along the bottom of the hull and drain.

The outlet port 26 is communicated to the air intake 16 of the engine 14 so as to enable the engine 14 to draw the ambient air for use in its combustion cycle through the inlet port 24, the interior of the container 22, and the outlet port 26. A rigid tube 28 having an outwardly extending annular flange 30 at one end thereof extends through the outlet port 26. The flange 30 on the tube 28 minimizes flow restriction. The tube 28 and the air intake 16 of the engine 14 are interconnected by a conduit 32 and a throttle 33 (FIG. 4) extending therebetween. The throttle 33 regulates the air flow into the air intake 16. The inlet port 24 has an annular flange 34 which is positioned and configured to mount a shield member, generally shown at 36, which will be discussed later in the application.

It is contemplated that the outlet port 26 may be communicated to a turbocharger, which in turn is communicated to the air intake 16 of the engine 14, to enable high pressure air to be supplied to the engine 14. The use and construction of turbochargers is well-known in the art and will not be detailed herein.

The container 22 includes a dividing wall 38 defining a first chamber 40 and a second chamber 42 within the container 22. That is, the wall 38 separates the interior of the container 22 into the first and second chambers 40, 42. The wall 38 has an opening 44 formed therethrough to communicate the first and second chambers 40, 42 such that the ambient air being drawn through the device 20 by the engine 14 flows from the first chamber 40 to the second chamber 42 via the opening 44.

The wall 38 extends to a floor surface 46 of the container 22 and the opening 44 is spaced upwardly from the floor surface 46 of the container 22 such that air is allowed to flow from the first chamber 40 to the second chamber 42 via the opening 44, but any water that becomes separated from the air by gravity in the first chamber 40 is prevented from flowing along the floor surface 46 to the second chamber 42 by the wall 38.

A rigid tube 48 having outwardly extending annular flanges 50, 52 at each end thereof extends through the opening 44. The flanges 50, 52 on the tube 48 minimize flow restriction. The tube 48 may be formed separately from the wall 38 and inserted into the opening 44. Alternatively, the tube 48 may be formed integrally with the wall 38.

The second chamber 42 of the container 22 includes a plurality of generally vertically extending and generally parallel baffles 54. These baffles 54 provide spaced apart generally vertical surfaces 56 that define a plurality of elongated tortuous paths between the inlet and outlet ports 24, 26. The tortuous paths each have at least one angular portion, generally shown at 58. These angular portions 58 are configured such that, as the engine 14 draws the ambient air through the interior of the container 22, the ambient air passes through the elongated tortuous paths so that any water suspended in the air is separated from the air by centrifugal force as the air passes through the angular portions 58 of the paths. As a result, the separated water flows downwardly along the surfaces 56 to the bottom 46 of the container 22 by gravity.

The angular portions 58 in the tortuous paths in the illustrated embodiment are provided by arcuate curves in the baffles 54. However, it is contemplated that the angular portions 58 may be provided by sharp angles instead of arcuate curves.

The baffles 54 provide a plurality of generally vertically extending trapping flanges 64 extending into the tortuous paths at the arcuate curves thereof. The trapping flanges 64 are positioned such that any water separated from the air as the air is drawn through the paths and flowing along the surfaces 56 towards the outlet port 26 is obstructed by the trapping flanges 64 and caused to flow downwardly along the trapping flanges 64 to the bottom 46 of the container 22. That is, these flanges 64 trap or block the water on the surfaces 56 from being drawn along with the air towards the outlet port 26.

The baffles 54 also provide a plurality of generally vertically extending ribs 66 formed integrally with the baffles 54 and extending into the tortuous paths. The ribs 66 are positioned to disrupt the laminar flow of the air drawn through the paths and flowing along the surfaces 56 to create turbulent flow. By disrupting the laminar flow to create turbulent flow, it is easier to separate the water suspended in the air as it flows through the angular portions 58.

The container 22 has one or more apertures 60 at the bottom 46 thereof so as to enable the water flowing to the bottom 46 of the container 22 to flow out from the container 22. The one or more apertures 60 each has a check valve 62 that permits water to drain from the container 22 through the one or more apertures 60, but prevents water from entering the container 22 through the one or more apertures 60.

It is contemplated that the one or more apertures 60 may be linked to a negative pressure source (vacuum), such as a bilge pump.

Figure 7:
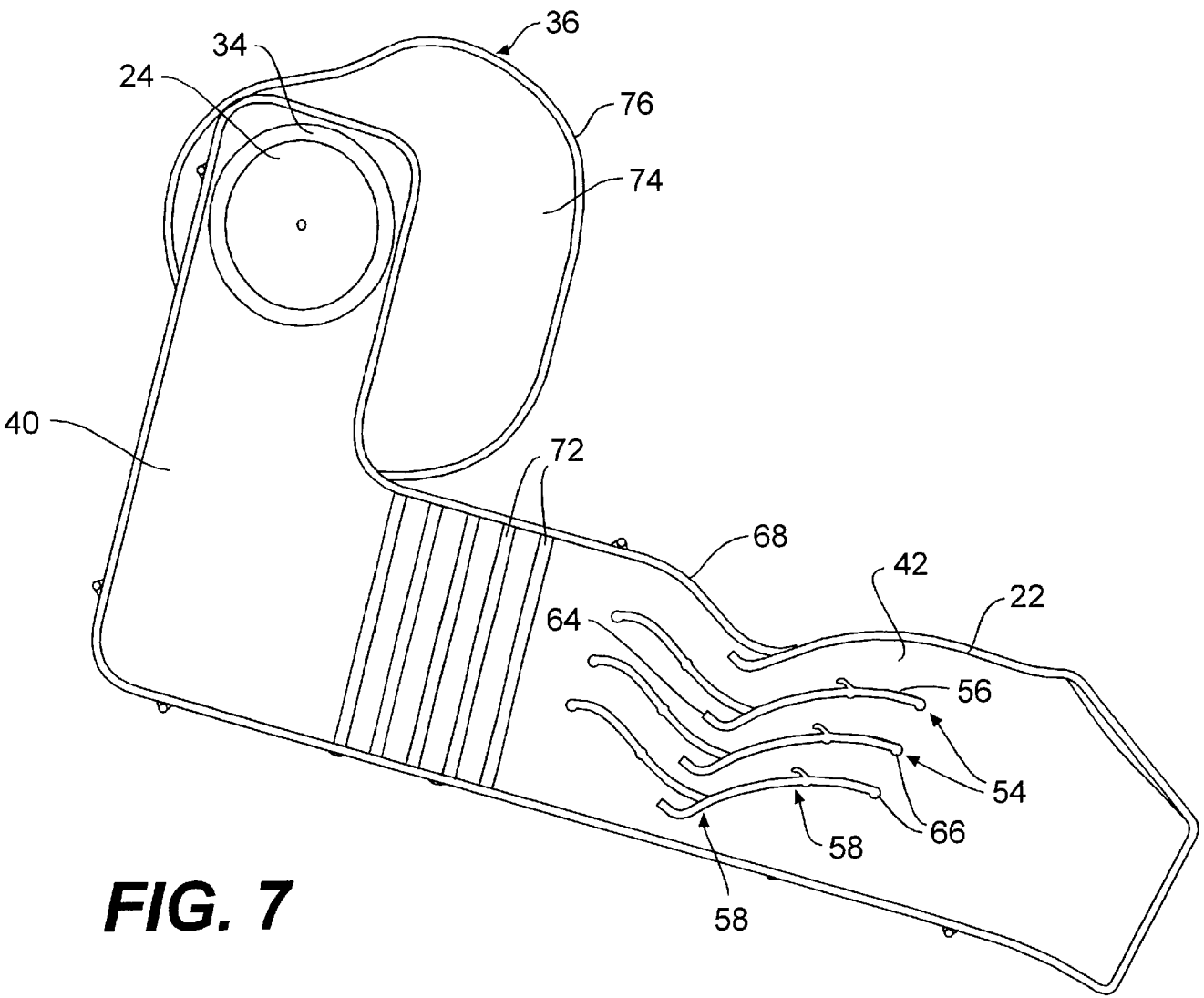
FIG. 7 is a bottom view of the upper section of the air/water separating device.
Figure 10A:
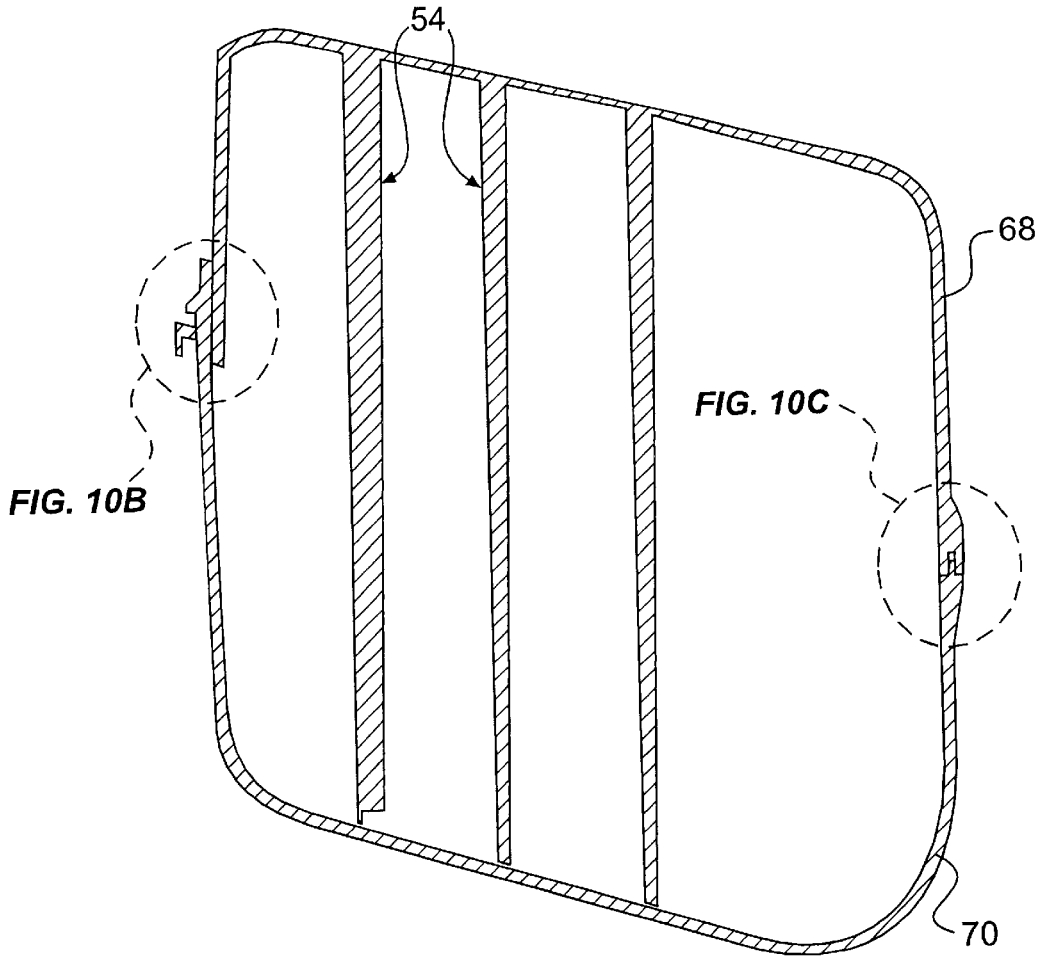
FIG. 10A is a cross-sectional view illustrating the connection between the upper and lower sections of the air/water separating device.
Figure 10B:
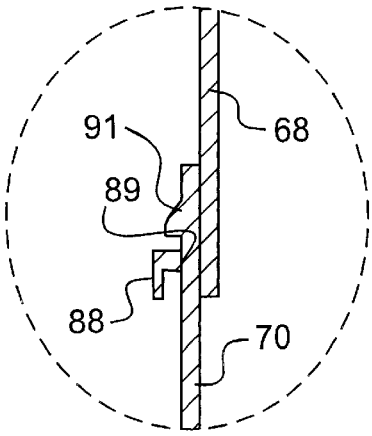
FIG. 10B is an enlarged view of a portion of the air/water separating device shown in FIG. 10A.
Figure 10C:
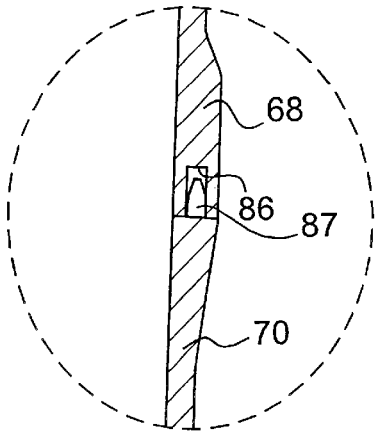
FIG. 10C is an enlarged view of a portion of the air/water separating device shown in FIG. 10A.

The container 22 is molded from plastic and comprises upper and lower sections 68, 70 with the baffles 54 being integrally formed with the upper section 68, as shown in FIG. 7. As illustrated in FIGS. 10A-10C, the sections 68, 70 on one side are secured together using a tongue and groove configuration. Specifically, the upper section 68 has a groove 86 and the lower section 70 has a protrusion or tongue 87 which is received within the groove 86, as shown in FIG. 10C. The tongue 87 and groove 86 may be secured together with an adhesive. The sections 68, 70 on the opposite side are secured together with a snap action. Specifically, the upper section 68 has a protrusion 88 with a hole 89 therethrough. The lower section 70 has a ramped portion 91 that is inserted through the hole 89 with a snap action to secure the sections 68, 70 together, as shown in FIG. 10B. However, the sections 68, 70 may be secured together in any known manner. The lower section 70 has a plurality of grooves (not shown) to receive the baffles 54 therein when the upper and lower sections 68, 70 are secured together, thereby securing the baffles 54 within the container.

It is contemplated that the baffles 54 may be formed separately from the upper section 68 and may be attached thereto by fasteners. Also, the baffles 54 may be formed separately and received between a plurality of grooves formed in both the upper and lower sections 68, 70.

The wall 38 is received in grooves 72 formed in the upper and lower sections 68, 70. The sections 68, 70 provide a series of these grooves 72 so that the positioning of wall 38 within the container 22 may be adjusted as desired. For example, it may be desirable to place the wall 38 in different positions for different engine applications so that the volumes of chambers 40, 42 are sized for optimal sound attenuation.

The air/water separating device 20 further includes the shield member 36 disposed in covering relation above the inlet port 24 to prevent water present in the ambient air from travelling directly downwardly into the inlet port 24.

The shield member 36 has an upper wall 74 and an annular flange 76 depending downwardly from the wall 74. The shield member 36 is positioned such that the upper wall 74 is disposed above the inlet port 24 in the covering relation to prevent the water present in the air from travelling directly downwardly into the inlet port 24. The annular flange 76 extends downwardly below the inlet port 24 so that the ambient air must flow upwardly interiorly of the flange 76 prior to entering the inlet port 24. This upward flow of the air tends to separate water from the upwardly air by gravity.

Figure 9:
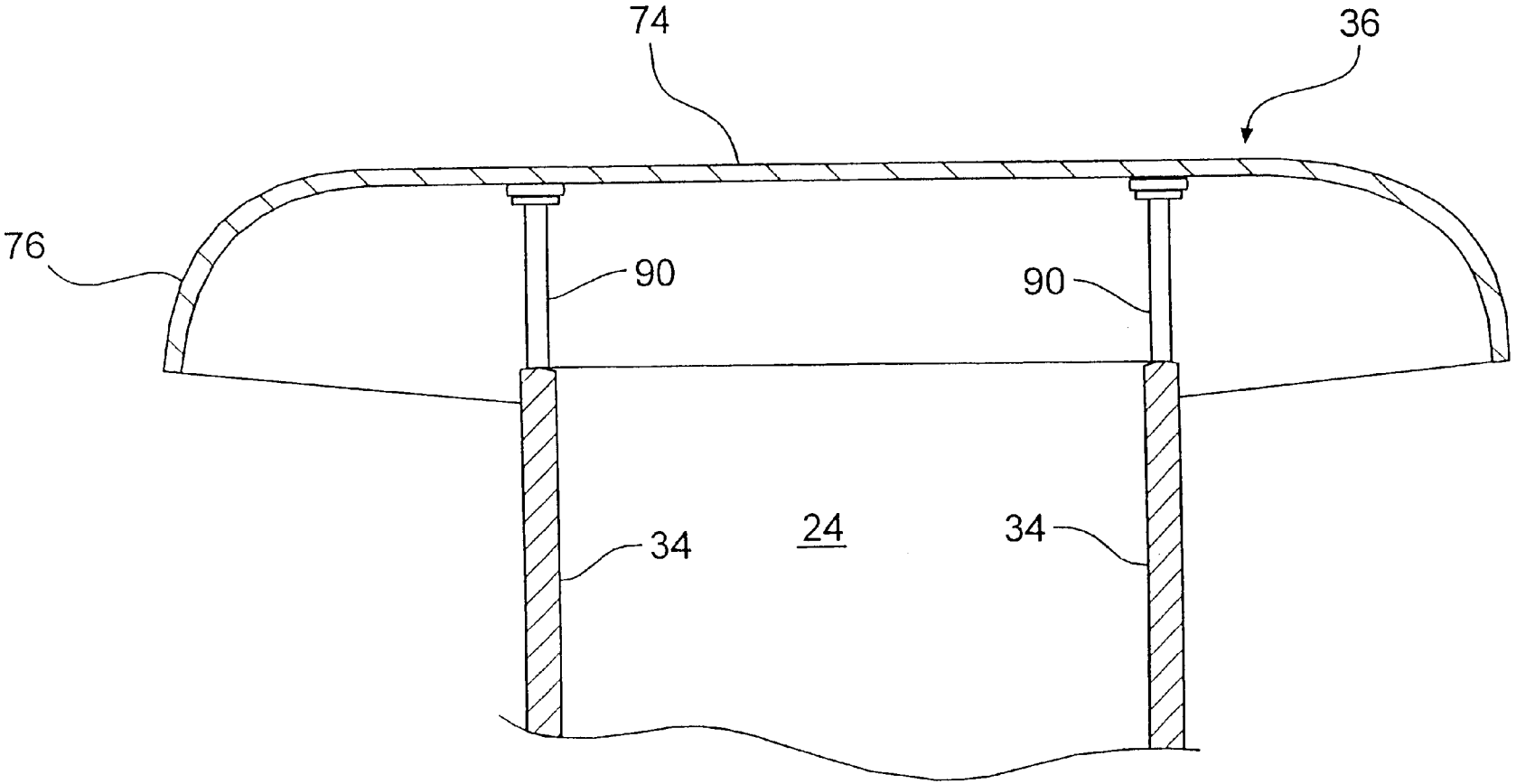
FIG. 9 is a partial cross-sectional view showing a shield member of the air/water separating device mounted over the inlet port.

As shown in FIG. 9, a plurality of supporting members 90 support the shield member 36 in its covering relation to the inlet port 24. Each of the supporting members 90 have one end secured to the annular flange 34 and the opposite end secured to the upper wall 74. The supporting members 90 may be secured as described above with bolts, screws, adhesives or any other known fasteners. Alternatively, the support members 90 may be integrally molded with the annular flange 34.

The size and location of the air/water separating device 20 also has significant importance. To begin with, the air/water separating device 20 is located in a position within the hull 12 that is spaced from the engine 14. The space between the air/water separating device 20 and the engine 14 significantly reduces the amount of heat transferred from the engine 14 to the air/water separating device 20. Specifically, because air is a poor thermal conductor, the space between the engine 14 and the device 20 provides for reduced heat transfer than if the device 20 were mounted on the engine 14. By reducing heat transfer from the engine 14, the oxygen content per unit volume is substantially higher because air is denser at lower temperatures. This leads to improved combustion when mixed with fuel supplied to the engine 14.

In addition, the air/water separating device 20 is positioned in a bow portion, generally shown at 78, of the hull 12 such that, during high speed travel of the watercraft 10 in which a substantial portion of the bow portion 78 of the hull 12 is lifted out of the body of water and elevated higher than the hull's stern portion, generally shown at 80, water present within the hull 12 will flow downwardly by gravity away from the air/water separating device 20 to the stern portion 80 where the water may be drained or pumped out of the hull 12 by the bilge. Because the water in the hull 12 flows away from the bow portion 78 during high speed travel, the air in the bow portion 78 tends to be drier, which leads to drier air being drawn into the device 20. Also, there tends to be less free water in the bow portion 78 that could potentially flow into the inlet port 24 by accident.

The watercraft 10 further comprises a fuel tank, generally shown at 82, wherein the fuel tank 82 includes a recess 84 that defines an air/water separating device receiving space that is complementary to the shape of the air/water separating device 20. The space enables the air/water separating device 20 to be mounted on the fuel tank 82 in a compact and interrelated manner. Therefore, space within the hull 12 can be optimized. In the embodiment shown, the device 20 is generally L-shaped and is received in the complimentary L-shaped recess 84 on the tank 82. The relatively shorter leg of the "L", which includes the first chamber 40, is positioned in the recess 84 along the front edge of the fuel tank 82. The longer leg of the "L", which includes the second chamber 42, is positioned in the recess 84 along the side edge of the fuel tank towards the stern portion 80 of the hull 12. The device 20 and recess 84 need not be L-shaped and may take any configuration so long as the device 20 mounts to the tank 82 within the recess 84.

Further, the size of the first and second chambers 40, 42 attenuates sounds from the engine 14 and from the air being drawn therethrough. It is contemplated that sound attenuation is increased by adding a Helmholtz resonator on top of the air/water separating device 20.

A further embodiment of the air/water separating device, indicated as 120, is illustrated in FIGS. 11–16. In this embodiment, the container 121 of the separating device 120 is adapted to mount a heat exchanger 122 for dissipating heat generated by a heat-generating component, such as an electrical device 124. In the illustrated embodiment, the electrical device 124 is a rectifier. The remaining elements of the separating device 120 are the same as the elements of the separating device 20 shown in FIGS. 2–7 and 9–10. The shield member 36 is not shown in FIGS. 11–16.

The rectifier 124, as is well known in the art, converts an alternating current input into a direct current output. The rectifier 124 has a pair of cables 128. The rectifier 124 receives an alternating current from the alternator via one of the cables 128 and provides a direct current to the battery of the watercraft, for example, via the other cable 128. The battery of the watercraft requires a supply of direct electrical power for battery charging. The rectifier 124 may also provide a direct current to other electrical devices of the watercraft, such as the ignition system.

When charging the battery for example, the electronic components of the rectifier 124 generate heat. The heat exchanger or heatsink 122 is connected to the rectifier 124 to remove this heat. In order to increase the cooling efficiency and effectiveness of the heatsink 122, the heatsink 122 is mounted within an opening 130 provided by the container 121 such that the fins 132 of the heatsink 122 project into the airflow path within the interior of the container 121 (shown in FIG. 16). As a result, the heatsink 122 draws heat from the rectifier 124 and dissipates the heat into the continuous flow of air through the container 121 by convection.

Specifically, the heatsink 122 has a body portion 134 which is conductively connected to the rectifier 124 such that heat generated by the rectifier 124 is drawn therefrom into the heatsink 122 by heat conduction. The heatsink 122 is preferably formed of a highly heat conductive material to aid in the heat conduction process.

Figure 13:
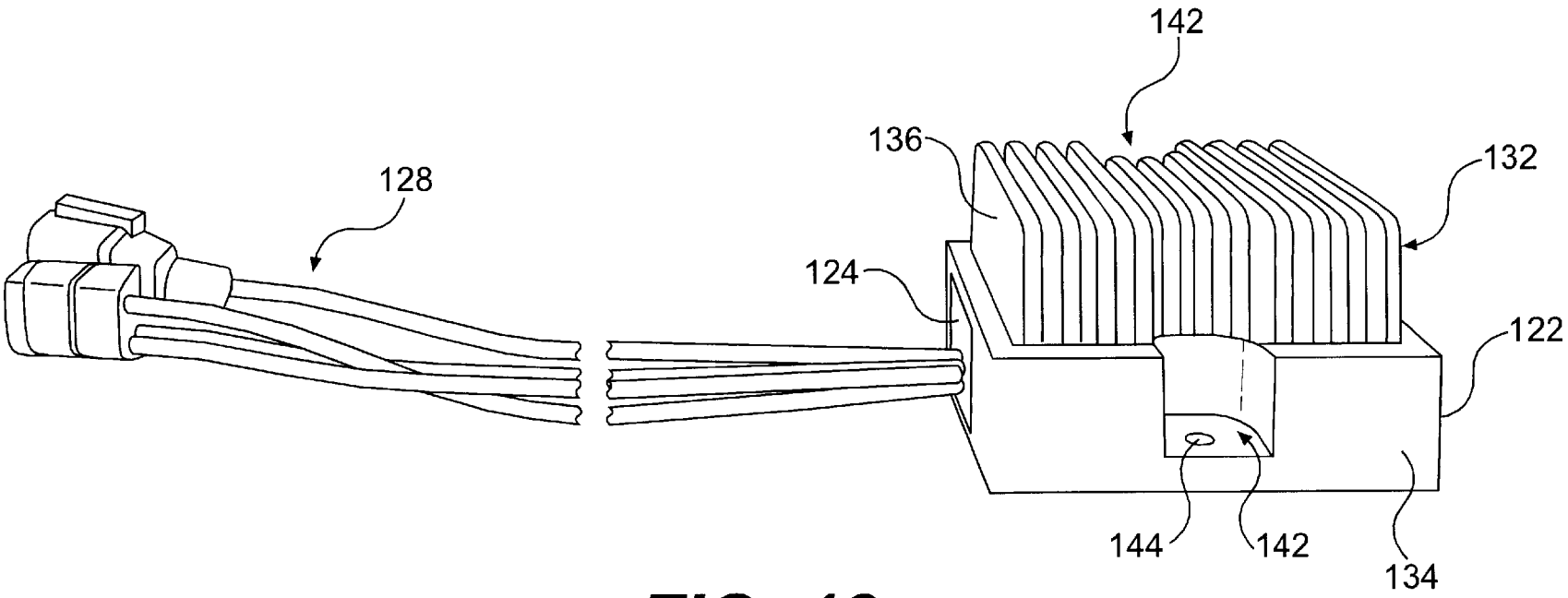
FIG. 13 is a perspective view illustrating the heat exchanger that is mounted to the container of the air/water separating device shown in FIG. 11.
Figure 16:
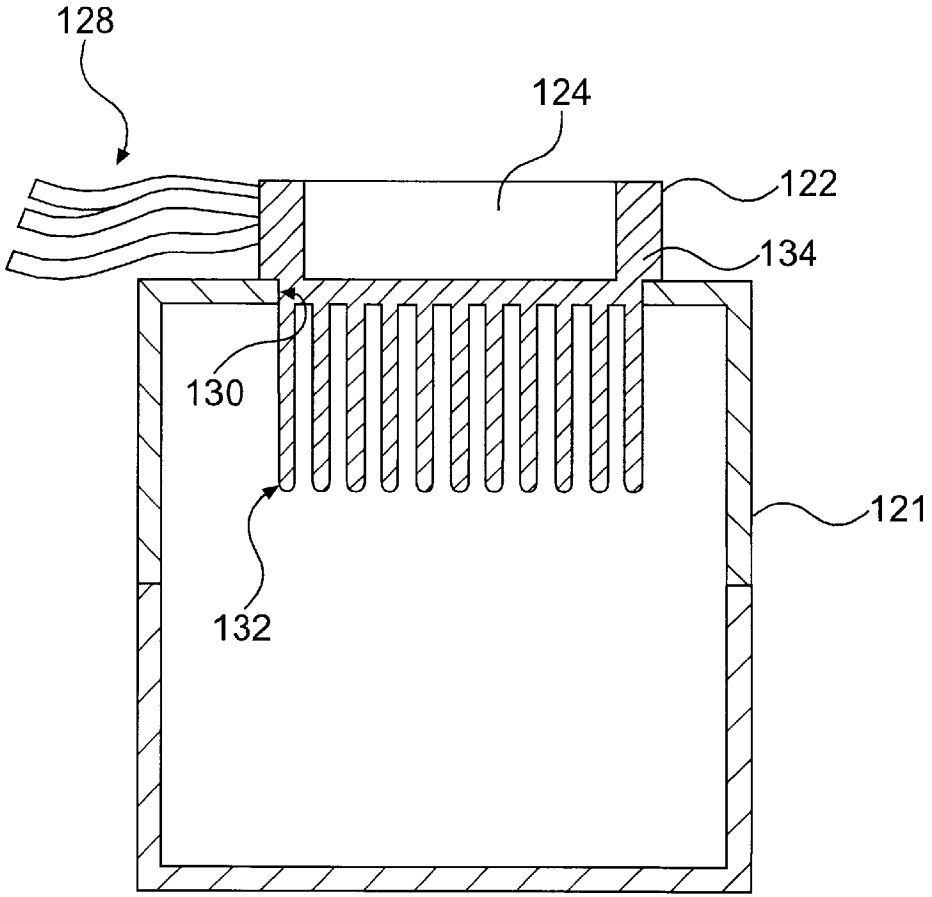
FIG. 16 is a cross-sectional view of the air/water separating device shown in FIG. 11.

As shown in FIGS. 13 and 16, the heatsink 122 includes a spaced series of fins 132 that extend outwardly from the body portion 134. The fins 132 serve to increase the area of the exterior surface 136 of the heatsink 122 and therefore the heat exchanging capacity thereof. The heatsink 122 also has recessed portions 142 on opposing edges. The recessed portions 142 have holes 144.

Figure 14:
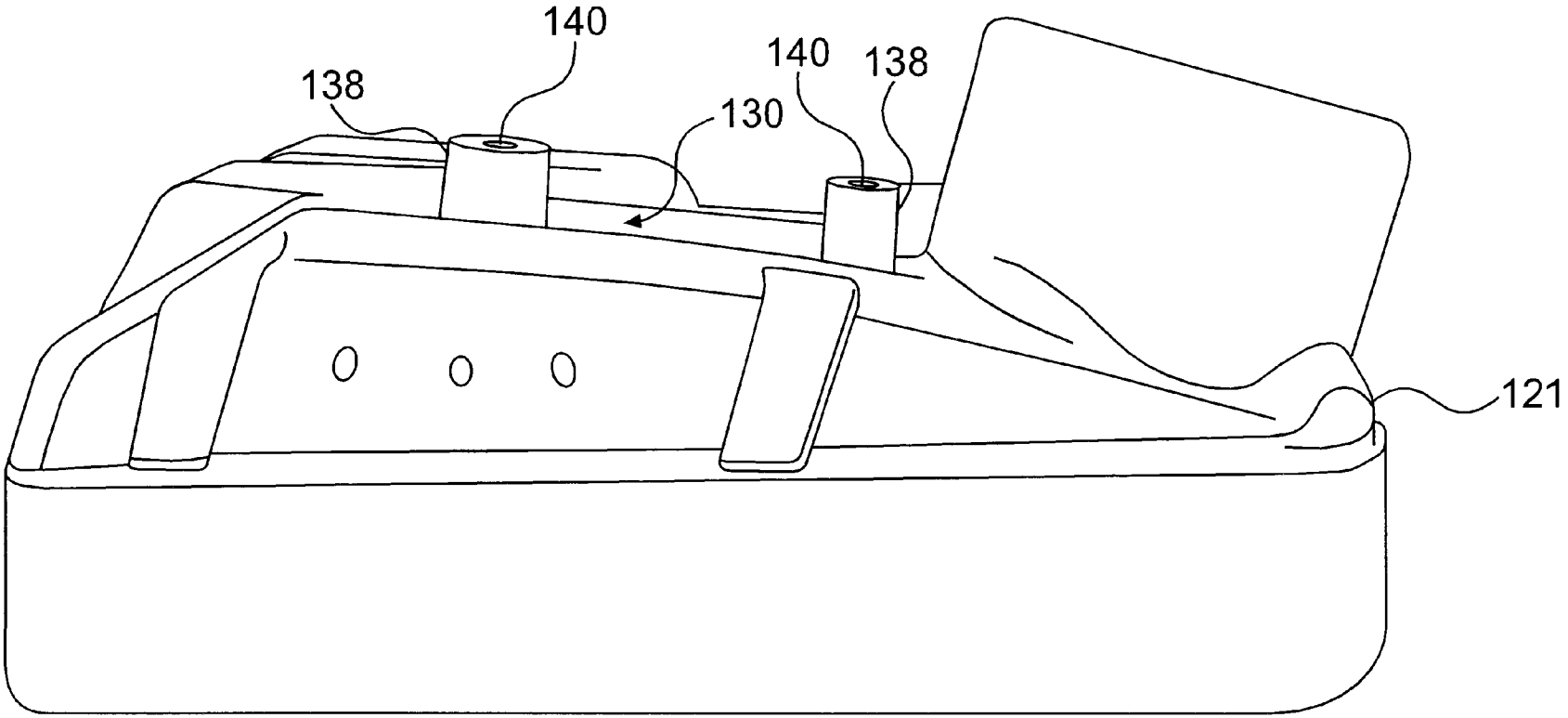
FIG. 14 is a perspective view illustrating the container of the air/water separating device shown in FIG. 11.
Figure 15:
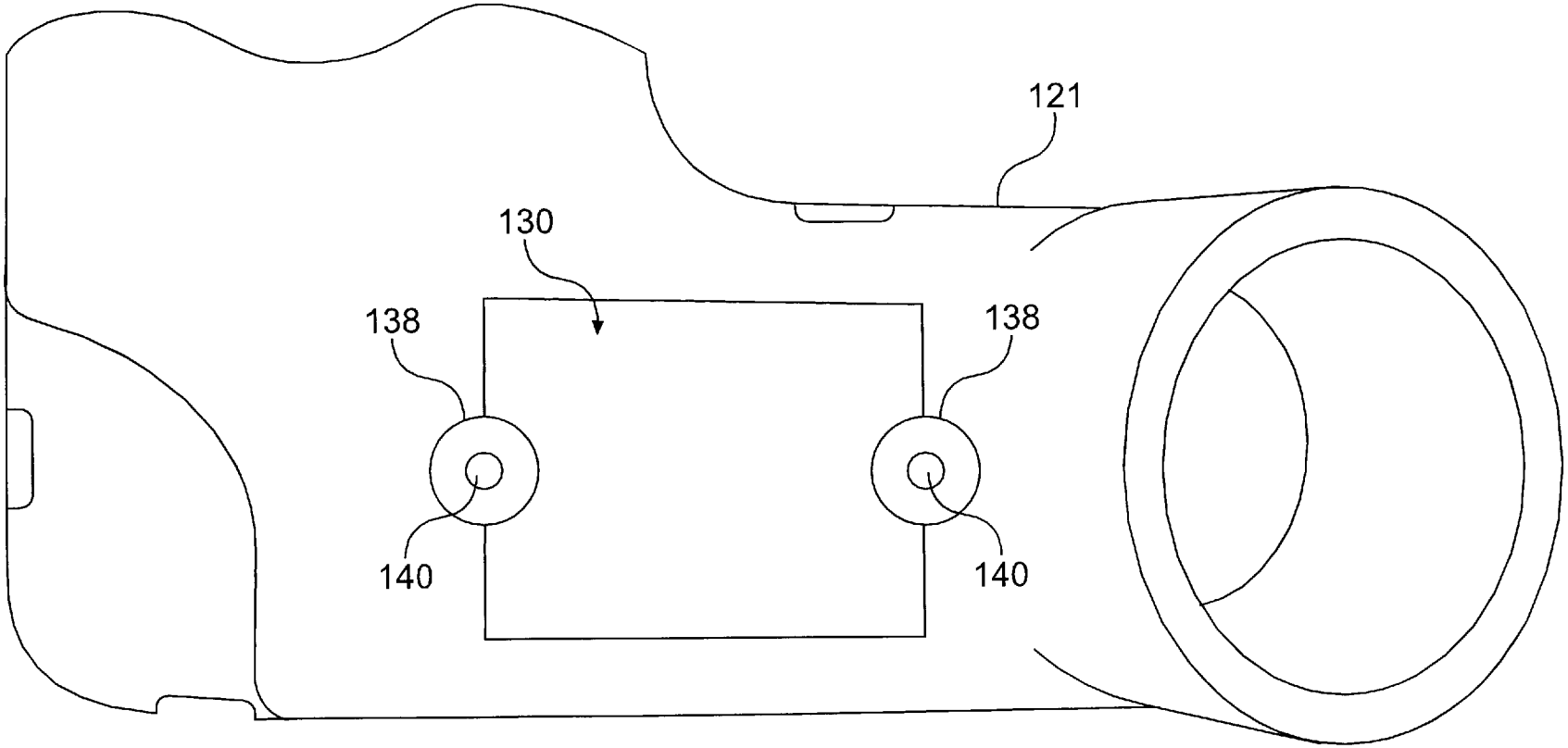
FIG. 15 is a top view of the container shown in FIG. 14.

As illustrated in FIGS. 14 and 15, the container 121 of the separating device 120 includes an opening 130 through the upper section and opposing mounting posts 138 adjacent the opening 130. The mounting posts have holes 140.

Figure 11:
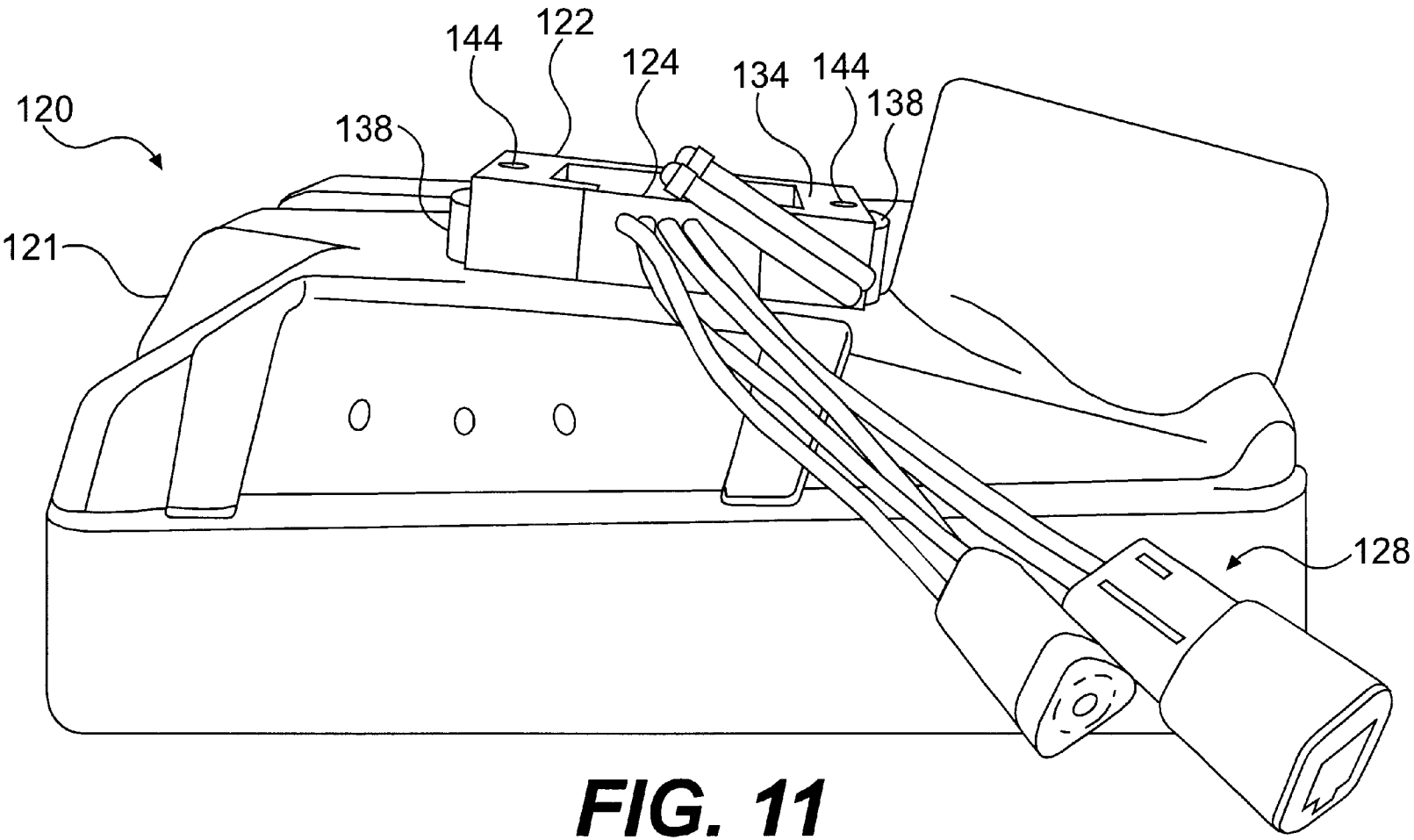
FIG. 11 is a perspective view illustrating a further embodiment of the air/water separating device.
Figure 12:
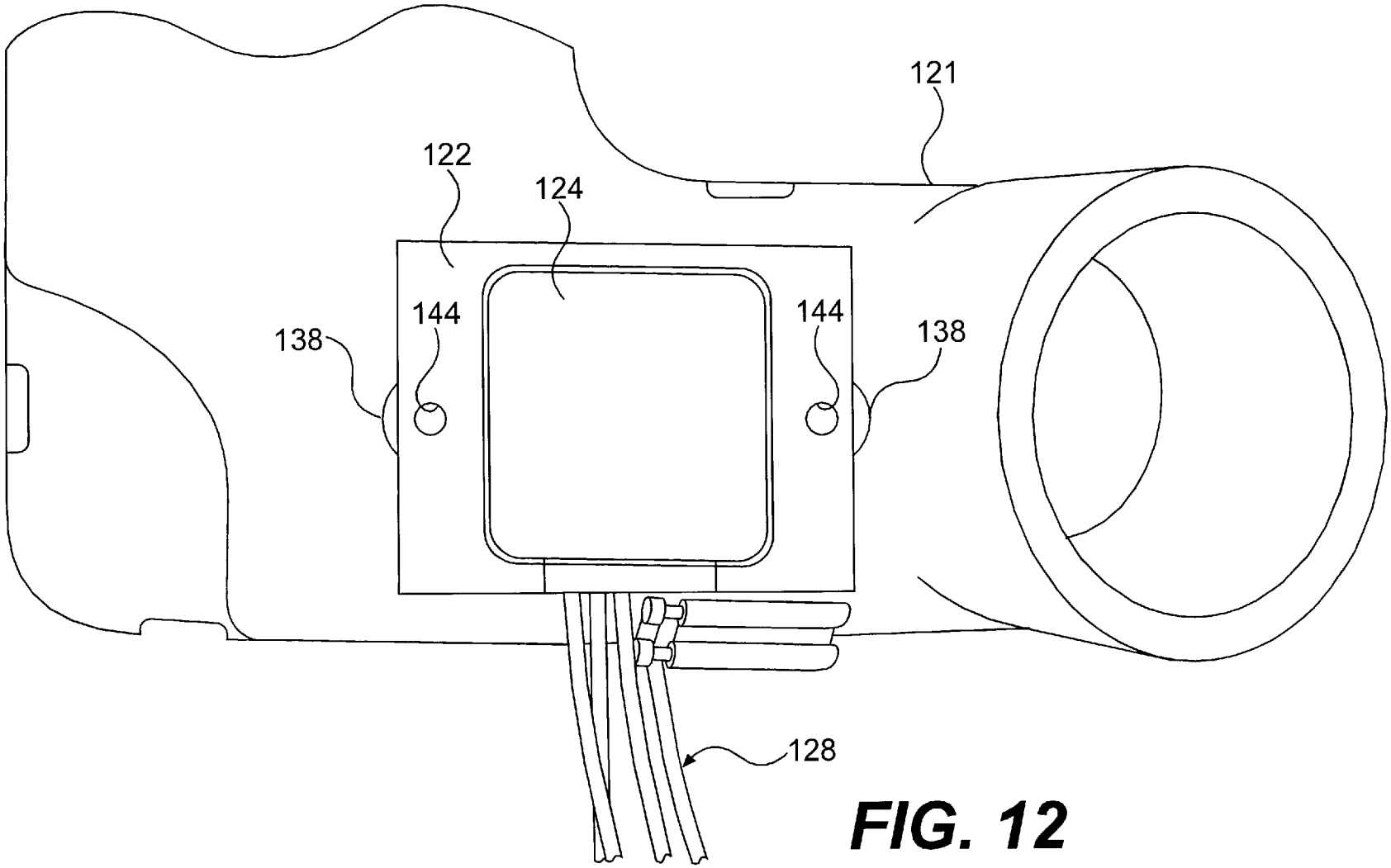
FIG. 12 is a top view of the air/water separating device shown in FIG. 11.

As shown in FIGS. 11 and 12, the recessed portions 142 of the heatsink 122 engage the mounting posts 138 such that the holes 140, 144 are aligned to receive a fastener therethrough. As a result, the heatsink 122 and hence the rectifier 124 is secured to the container 121. When mounted, the fins 132 project into the interior of the container 121, as shown in FIG. 16. In the illustrated embodiment, the heatsink 122 is mounted such that the fins 132 project into the first chamber 40 of the container.

The air flow, created by the drawing of air by the engine 14 through the interior of the container 121, provides a constant cooling medium across the fins 132 of the heatsink 122 and dissipates the heat from the rectifier 124.

Because the positioning of the heatsink 122 within the container 121 provides a continuous flow of air across the fins 132 of the heatsink 122, the heatsink 122 is very efficient in dissipating heat. As a result, the rectifier 124 has an increased life expectancy. Further, the rectifier 124 can be constructed smaller due to the heat exchanging capacity of the heatsink 122.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed:

1. A watercraft comprising:

a hull;

an internal combustion engine having an air intake for receiving at least ambient air to be supplied to said engine;

a propulsion system connected to said engine, said propulsion system being constructed and arranged to propel said watercraft along a surface of a body of water using power from said engine; and an air/water separating device comprising a container enclosing an interior space, said container having a bottom, an inlet port and an outlet port, said inlet port enabling the ambient air to enter said container, said outlet port including a tube extending from the outlet port at a position above the bottom and being communicated to said air intake of said engine so as to enable said engine to draw the ambient air into said air intake through said inlet port, said interior space and said outlet part, said air/water separating device having structure providing spaced apart generally vertical surfaces defining a plurality of elongated tortuous paths between said inlet and outlet ports, said tortuous paths having one or more vertically oriented angular portions and being positioned and configured such that, as said engine draws the ambient air through said container interior, the ambient air passes through said elongated tortuous paths so that water suspended in the ambient air is separated from the ambient air as the ambient air passes through the vertically oriented angular portions of said paths with the separated water flowing downwardly along said generally vertical surfaces to the bottom of said container by gravity, said container having one or more apertures at said bottom so as to enable the water flowing to said bottom to flow out from said container.

2. A watercraft according to claim 1, wherein said structure providing said surfaces comprises a plurality of generally vertically extending and generally parallel baffles.

3. A watercraft according to claim 2, wherein said angular portions in said tortuous paths are provided by arcuate curves in said baffles.

4. A watercraft according to claim 2, wherein said baffles provide a plurality of generally vertically extending trapping flanges extending into said tortuous paths in proximity to arcuate curves thereof, said trapping flanges being positioned such that water separated from the air drawn through said paths and flowing along said surfaces towards said outlet port is obstructed by said trapping flanges and caused to flow downwardly along said trapping flanges to said bottom of said container.

5. A watercraft according to claim 3, wherein said baffles provide a plurality of generally vertically extending trapping flanges extending into said tortuous paths in proximity to said arcuate curves thereof, said trapping flanges being positioned such that water separated from the air drawn through said paths and flowing along said surfaces towards said outlet port is obstructed by said trapping flanges and caused to flow downwardly along said trapping flanges to said bottom of said container.

6. A watercraft according to claim 4, wherein said baffles are integrally formed with said container.

7. A watercraft according to claim 5, wherein said baffles are integrally formed with said container.

8. A watercraft according to claim 1, wherein said one or more apertures each has a check valve adapted to permit water to drain from said container through said one or more apertures while preventing water from entering said container through said one or more apertures.

9. A watercraft according to claim 2, wherein said baffles provide a plurality of generally vertically extending ribs extending into said tortuous paths, said ribs being positioned to disrupt the laminar flow of the ambient air drawn through said paths towards said outlet port such that the ambient air will flow turbulently through said paths.

10. A watercraft according to claim 3, wherein said baffles provide a plurality of generally vertically extending ribs extending into said tortuous paths, said ribs being positioned to disrupt the laminar flow of the ambient air drawn through said paths towards said outlet part such that the ambient air will flow turbulently through said paths.

11. A watercraft according to claim 4, wherein said baffles provide a plurality of generally vertically extending ribs extending into said tortuous paths, said ribs being positioned to disrupt the laminar flow of the ambient air drawn through said paths towards said outlet port such that the ambient air will flow turbulently through said paths.

12. A watercraft according to claim 5, wherein said baffles provide a plurality of generally vertically extending ribs extending into said tortuous paths, said ribs being positioned to disrupt the laminar flow of the ambient air drawn through said paths towards said outlet port such that the ambient air will flow turbulently through said paths.

13. A watercraft according to claim 6, wherein said baffles provide a plurality of generally vertically extending ribs extending into said tortuous paths, said ribs being positioned to disrupt the laminar flow of the ambient air drawn through said paths towards said outlet port such that the ambient air will flow turbulently through said paths.

14. A watercraft according to claim 1, wherein said inlet port is upward facing, and said air/water separating device comprises a shield member disposed in covering relation above said inlet port to inhibit water from travelling directly into said inlet port.

15. A watercraft according to claim 11, further comprising:

a conduit connected at one end to said air intake of said engine, wherein said air/water separating device is mounted within said hull in spaced apart relation from said engine, said tube of the outlet port is connected to the other end of said conduit so as to enable said engine to draw the ambient air into said air intake through said inlet port, said interior space of said container, said outlet port, and said conduit.

16. A watercraft according to claim 15, wherein said air/water separating device is positioned in a bow portion of said hull such that, when said bow portion is elevated higher than a stem portion of said hull during operation of said watercraft, water present within said hull will flow downwardly by gravity away from said air/water separating device to said stern portion of said hull.

17. A watercraft according to claim 11, wherein said container comprises at least one wall defining a first chamber and a second chamber within said container, said wall having at least one opening formed therethrough to communicate said first and second chambers such that the ambient air being drawn by said engine flows from said first chamber to said second chamber via said opening, said at least one opening being spaced upwardly from a floor surface of said container and said wall being constructed and arranged to prevent any water that has become separated from the air in said container from flowing along said floor surface between said first and second chambers.

18. A watercraft according to claim 17, wherein each of said at least one openings has a tubular member extending therethrough with a first end in said first chamber and a second end in said second chamber.

19. A watercraft according to claim 17, wherein at least one said aperture is provided in said first chamber and at least said aperture is provided in said second chamber.

20. A watercraft according to claim 1, further comprising:

a fuel tank, wherein said fuel tank has a recess formed therein and said container of said air/water separating device is mounted to said fuel tank within said recess.

21. A watercraft according to claim 20, wherein each of said container and said recess on said fuel tank are generally L-shaped.

22. A watercraft according to claim 1, further comprising:

a heat exchanger, said heat exchanger connected to a component of the watercraft and adapted to draw heat therefrom, wherein said heat exchanger is mounted within an opening provided in said container of said air/water separating device such that said heat exchanger is positioned into the flow of air through said container to dissipate the heat drawn from said component.

23. A watercraft according to claim 22, wherein said component is an electrical component.

24. A watercraft comprising:

a hull having a forward portion oriented toward a forward driving direction;

an internal combustion engine having an air intake for receiving at least ambient air to be supplied to said engine;

a propulsion system connected to said engine, said propulsion system being constructed and arranged to propel said watercraft along a surface of a body of water using power from said engine;

a fuel tank connected to and disposed forwardly of the engine within the hull, the fuel tank having a rear wall;

a conduit connected at a first end to said air intake; and an air/water separating device mounted within said hull in spaced apart relation from said engine such that an amount of heat transferred from said engine to said air/water separating device is significantly reduced, said air/water separating device comprising a container enclosing an interior space, said container having an inlet port enabling the ambient air to enter said container and an outlet port connected to a second end of said conduit so as to enable said engine to draw the ambient air into said air intake thereof through said inlet port, said interior space, said outlet port, and said conduit, wherein the inlet port is disposed forwardly of the rear wall of the fuel tank, wherein said fuel tank includes a recess, said air/water separating device being mounted to said fuel tank within said recess.

25. A watercraft according to claim 24, wherein said air/water separating device is positioned in a bow portion of said hull such that, when said bow portion is elevated higher than a stem portion of said hull during operation of said watercraft, water present within said hull will flow downwardly by gravity away from said air/water separating device to said stem portion of said hull.

26. A watercraft according to claim 24, wherein said inlet port is upwardly facing, said air/water separating device comprises a shield member disposed in covering relation above said inlet port to inhibit water from travelling into said inlet port.

27. A watercraft according to claim 24, wherein container is generally L-shaped.

28. A watercraft comprising:

a hull;

fuel tank;

an internal combustion engine communicated with said fuel tank and having an air intake for receiving at least ambient air to be supplied to said engine from said fuel tank;

a propulsion system connected to said engine, said propulsion system being constructed and arranged to propel said watercraft along a surface of a body of water using power from said engine; and an air/water separating device comprising a container enclosing an interior space, said container having an inlet port enabling the ambient air to enter said container and an outlet port communicated to said air intake of said engine so as to enable said engine to draw the ambient air through said inlet port, said interior space and said outlet port, wherein said fuel tank defines a recess formed therein and said container of said air/water separating device is mounted to said fuel tank within said recess.

29. A watercraft according to claim 28, wherein each of said container and said recess on said fuel tank are generally L-shaped.

30. A watercraft according to claim 28, wherein said inlet port is upwardly facing, said air/water separating device comprises a shield member disposed in covering relation above said inlet port to inhibit water from travelling into said inlet port.

31. A watercraft according to claim 28, wherein said air/water separating device is positioned in a bow portion of said hull such that, when said bow portion is elevated higher than a stern portion of said hull during operation of said water-craft, water present within said hull will flow downwardly by gravity away from said air/water separating device to said stern portion of said hull.

32. A watercraft comprising:

a hull;

a fuel tank;

an internal combustion engine communicated with said fuel tank and having an air intake for receiving at least ambient air to be supplied to said engine from said fuel tank;

a propulsion system connected to said engine, said propulsion system being constructed and arranged to propel said water craft along a surface of a body of water using power from said engine; a conduit connected at a first end to said air intake; and an air/water separating device mounted within said hull in spaced apart relation from said engine, said air/water separating device comprising a container enclosing an interior space, said container having an upwardly facing inlet port enabling the ambient air to enter said container and an outlet port connected to a second end of said conduit so as to enable said engine to draw the ambient air into said air intake thereof through said inlet port, said interior space, said outlet port, and said conduit, said air/water separating device having structure providing spaced apart generally vertical surfaces defining a plurality of elongated tortuous paths between said inlet and outlet ports, said tortuous paths having one or more angular portions and being positioned and configured such that, as said engine draws the ambient air through said interior space, the ambient air passes through said elongated tortuous paths so that water suspended in the ambient air is separated from the ambient air force as the ambient air passes through angular portions of said paths with the separated water flowing downwardly along said surfaces to a bottom of said container by gravity, said container having at least one wall defining a first chamber and a second chamber within said container, said wall having at least one opening formed therethrough to communicate said first and second chambers such that the ambient air being drawn by said engine flows from said first chamber to said second chamber via said opening, said at least one opening being spaced upwardly from a floor surface of said container and said wall being constructed and arranged to prevent any water that has become separated from the ambient air in said container from flowing along said floor surface between said first and second chambers, said container having one or more apertures at said bottom so as to enable the water flowing to said bottom of said container to flow out from said container, said air/water separating device including a shield member disposed in covering relation above said inlet port to prevent water present in the ambient air from travelling directly downwardly into said inlet port, wherein said fuel tank has a recess formed therein and said container of said air/water separating device is mounted to said fuel tank within said recess.

33. An air/water separating device for a watercraft, said air/water separating device having a top that is upwardly facing when the watercraft is in an upright position, the watercraft comprising an internal combustion engine having an air intake for receiving at least ambient air to be supplied to the engine, said air/water separating device comprising:

a container enclosing an interior space, said container having a bottom, an inlet port and an outlet port, said inlet port enabling the ambient air to enter said container, said outlet port including a tube extending from the outlet port at a position above the bottom and being adapted to be communicated to said air intake of said engine so as to enable said engine to draw the ambient air into said air intake through said inlet port, said interior space of said container and said outlet port;

structure within said container providing spaced apart generally vertical surfaces defining a plurality of elongated tortuous paths between said inlet and outlet ports, said tortuous paths having one or more vertically oriented angular portions and being positioned and configured such that, as said engine draws the ambient air through said interior space, the ambient air passes through said elongated tortuous paths so that water suspended in the ambient air is separated from the ambient air as said air passes through the vertically oriented angular portions of said paths with the separated water flowing downwardly along said surfaces to the bottom of said container by gravity; and one or more apertures at said bottom so as to enable the water flowing to said bottom of said container to flow out from said container.

34. An air/water separating device according to claim 33, wherein said inlet port is upwardly facing and said air/water separating device further comprises a shield member disposed in covering relation above said inlet port to prevent water present in the ambient air from travelling directly downwardly into said inlet port.

35. An air/water separating device according to claim 33, wherein said container comprises at least one wall defining a first chamber and a second chamber within said container, said wall having at least one opening formed therethrough to communicate said first and second chambers such that the ambient air being drawn by said engine flows from said first chamber to said second chamber via said opening, wherein said at least one opening is spaced upwardly from a floor surface of said container and said wall is constructed and arranged to prevent any water that has become separated from the ambient air in said container from flowing along said floor surface between said first and second chambers.

36. An air/water separating device according to claim 33, further comprising:

a heat exchanger, said heat exchanger being adapted to be connected to a component of the watercraft in order to draw heat therefrom, wherein said heat exchanger is configured to be mounted within an opening provided in said container of said air/water separating device such that said heat exchanger is positioned into the flow of air through the container in order to dissipate the heat drawn from said component.

37. An air/water separating device according to claim 36, wherein said component is an electrical component.

38. An air/water separating device for a watercraft, said air/water separating device having a top that is upwardly facing when the watercraft is in an upright position, the watercraft comprising an internal combustion engine having an air intake for receiving at least ambient air to be supplied to the engine and a throttle connected between the engine and the air/water separating device, said air/water separating device comprising:

a container enclosing an interior space, said container having an upwardly facing inlet port and an outlet port, said inlet port enabling the ambient air to enter said container, said outlet port being adapted to be communicated to said air intake of said engine so as to enable said engine to draw the ambient air through said inlet port, said interior space of said container and said outlet port;

a shield member disposed in covering relation above said inlet port to prevent water present in the ambient air from traveling directly downwardly into said inlet port; and structure within said container providing spaced apart generally vertical surfaces defining a plurality of elongated tortuous paths between said inlet and outlet ports, said tortuous paths having one or more angular portions and being positioned and configured such that, as said engine draws the ambient air through said interior space, the ambient air passes through said elongated tortuous paths so that water suspended in the ambient air is separated from the ambient air as the ambient air passes through angular portions of said paths with the separated water flowing downwardly along said surfaces to a bottom of said container by gravity, said container having one or more apertures at said bottom so as to enable the water flowing to said bottom of said container to flow out from said container.

* * * * *